US006735805B2

(12) United States Patent
Chapin

(10) Patent No.: US 6,735,805 B2
(45) Date of Patent: May 18, 2004

(54) UNIVERSAL BOLT CLEANING ATTACHMENT

(76) Inventor: Chad Douglas Chapin, N.4396 Weasel Dam Rd., Tigerton, WI (US) 54486

( * ) Notice: Subject to any disclaimer, the term of this patent is extended or adjusted under 35 U.S.C. 154(b) by 112 days.

(21) Appl. No.: 10/145,356

(22) Filed: May 15, 2002

(65) Prior Publication Data

US 2003/0213077 A1 Nov. 20, 2003

(51) Int. Cl.[7] ..... A46B 13/02

(52) U.S. Cl. ..... 15/88; 15/21.1; 15/104.04; 451/231; 451/545

(58) Field of Search ..... 15/21.1, 88, 104.04; 29/81.05, 81.12; 451/231, 545

(56) References Cited

U.S. PATENT DOCUMENTS 3,026,550 A * 3/1962 Bollin ..... 15/4
4,000,552 A * 1/1977 Pleis ..... 29/76.1
4,180,884 A * 1/1980 Hess et al. ..... 15/21.1
4,433,448 A 2/1984 True
4,734,950 A 4/1988 Schenke et al.
5,901,400 A 5/1999 Fulop
6,122,790 A 9/2000 Wambeke

* cited by examiner

*Primary Examiner*—Mark Spisich

(57) ABSTRACT

A motor driven and or mounted cleaning attachment manufactured of a rigid material, having no need for adjustment, for the purpose of clearing multiple bolt pitch diameters and lengths. Consist of plates sandwiched and fastened together. Mounting plate manufactured to mount directly to motor housing, or a base being driven by a motor, jack-shaft and pulley or gear driven system. The mounting plate is bored with an indexed pattern of multiple diameter bored through holes. Center working plate is mounted to the mounting plate, and has the same indexed pattern of bored through holes as the mounting plate. Except the index has been partially bored away and exposed to the cleaning wheel bore. The Cleaning wheel rotates within the cleaning wheel bore located in the center working plate. Cover plate is mounted to the center working plate, and has the same indexed pattern of through holes. A free hand portion has been made in the said mounting plate sandwiched unit allowing for free hand cleaning without the need for another machine.

1 Claim, 5 Drawing Sheets

UNIVERSAL BOLT CLEANING ATTACHMENT

BACKGROUND OF INVENTION

1. Field of Invention

Invention is a motor driven machine for cleaning multi diameter bolts and objects and their varied pitches or diameters with no need for setup or adjustment once installed.

2. Description of Prior Art

Prior methods of cleaning bolt threads of unwanted derbies such as grease, rust, locking and sealing chemicals is a time consuming and laborious task, and at times can be unsafe. Wire hand brushes have been used for many years, but are slow and fairly ineffective on today's hard thread locking chemicals. Another method is a wire bristled wheel mounted on today's high-speed bench grinders. This is the fastest method and works well however as the wire bristle wheels spin the bristles flex and occasionally grab the threaded screw and can launch it at an high rate of speed causing damage or injury. Another method is by chemical bath, but this is also time consuming and can be hazardous to both the operator and environment. Other attempts either require setup for each change in bolt diameter, or are so complex that they are not cost effective to maintain or use for the average home shop or small entity.

SUMMARY

In accordance with the present invention the cleaner consists of a mounting plate with an index of through holes is attached to the motor housing or alternate drive system. The center working plate having the same index of through holes being bored off center of the cleaning wheel area located in the center of the center working plate. Said mounting plate and center working plate are fastened together, using the four mounting plates through holes and the tapped holes in the center working plate. A wheel washer is placed over the motor or drive armature followed by the carbon strand wire cleaning wheel. A second wheel washer is now placed over the motor armature, followed by lock washer and nut, and tightened. The cover plate is then fastened using the four through holes and tapped holes in the center working plate. This invention has conquered all of the fore mentioned problems and can be made cost effectively to dimensions of different diameters and requirements of the manufacturer or mounting requirements of the end user.

OBJECTS AND OBJECTIVES

First: Invention is convertible.

Second: Invention is durable for long service.

Third: Maintenance is low and consists of occasional replacement of the cleaning wheel that can be purchased at any hardware supply or by wholesale vender.

Fourth: Invention and method is fast and effective.

Fifth: After initial assembly there is no adjustments necessary to clean various diameter bolts.

Sixth: A separate mounting or backing plate allows for easy manufacturing changes for different mounting requirements of the user if wanted.

Seventh: Said invention will mount to any bench grinder, which are lady in service or can be purchased at a minimal cost depending on size and horse power.

Eighth: This invention allows a safe method of cleaning bolts and objects of varied diameter and pitch with no change over.

DRAWINGS

Reference Numerals in Drawings

| | |
|---|---|
| 1 = Mounting Plate | 12 = Lock Washer |
| 2 = Center Working Plate | 13 = Armature Nut |
| 3 = Cover Plate | 14 = Armature Hole |
| 4 = Cleaning Wheel | 15 = Motor Armature |
| 5 = Through Mounting Hole | 16 = Free Hand Portion |
| 6 = Through Assembly Hole | 17 = Cleaning Wheel Bore |
| 7 = Through Hole for Armature | 18 = Motor Mounting Hole |
| 8 = Indexed Diameter Through Hole | 19 = Motor |
| 9 = Tapped Hole | |
| 10 = Assembly Screw | |
| 11 =Cleaning Wheel Washer | |

FIGS. 1–3C

Figure 1:
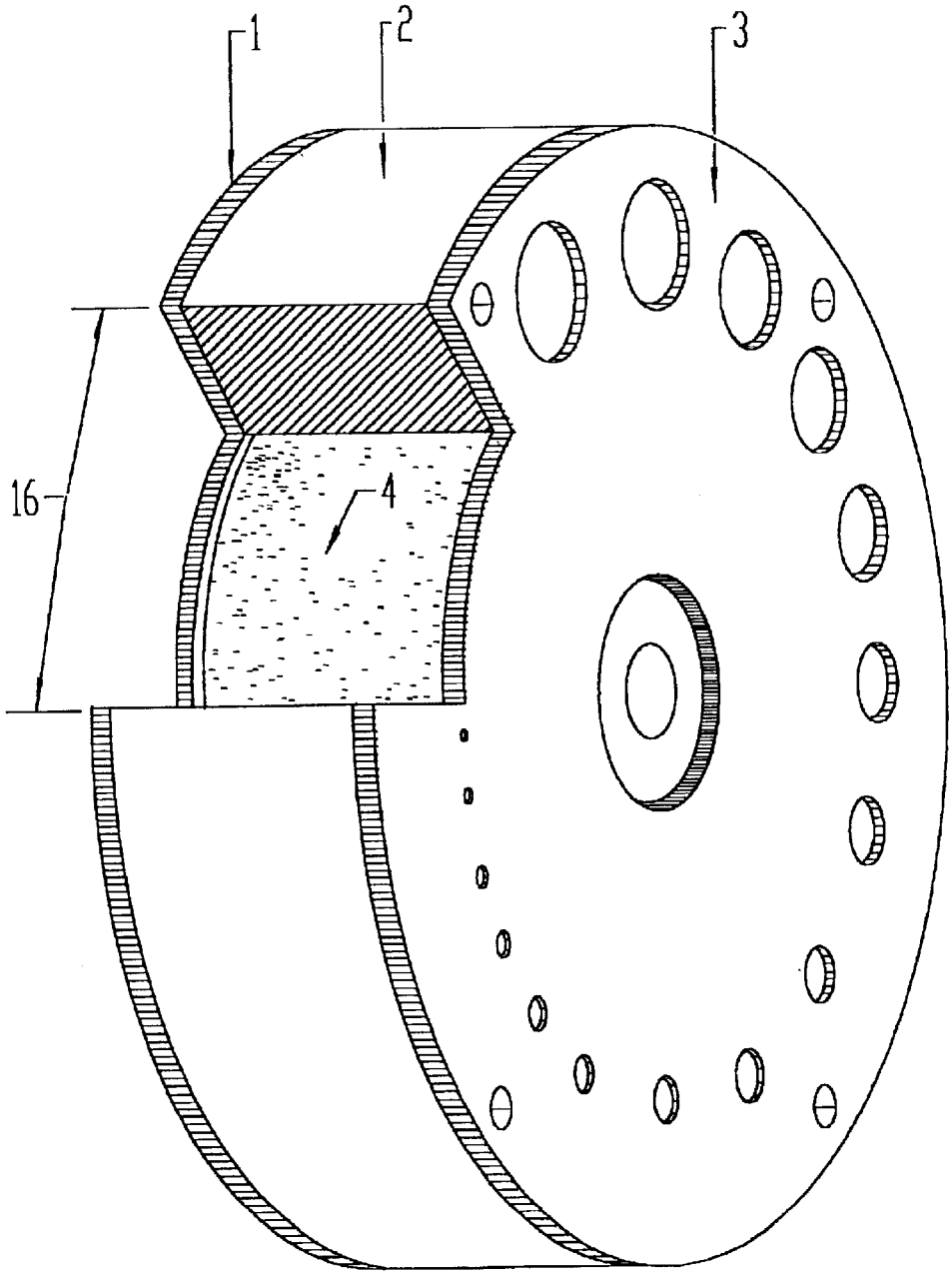
FIG. 1 is an assembled view of invention.

FIG. 1 is a perspective view of the assembled invention.

Figure 2:
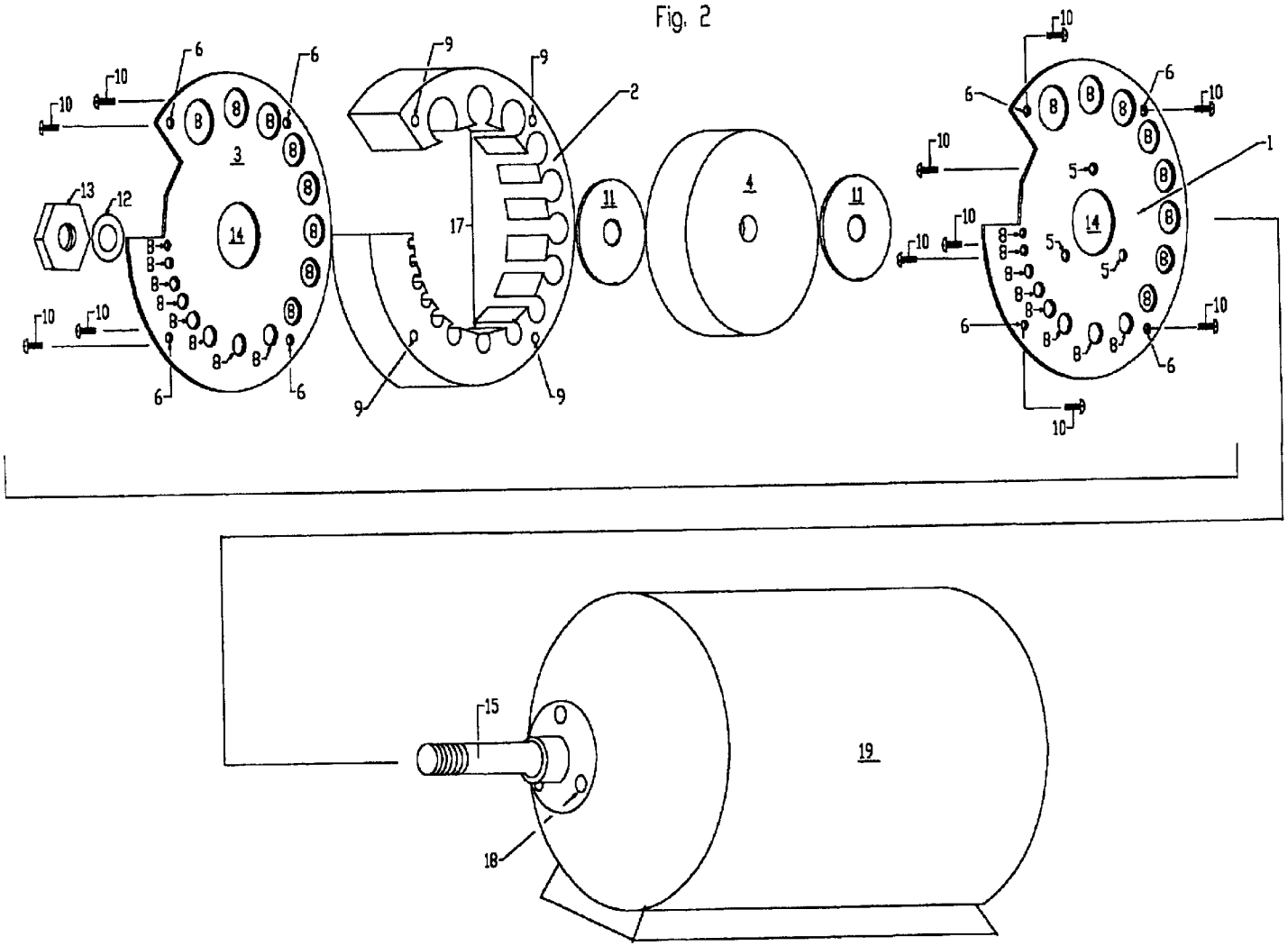
FIG. 2 is an exploded view of invention.

FIG. 2 is an exploded view of invention.

Figure 3A:
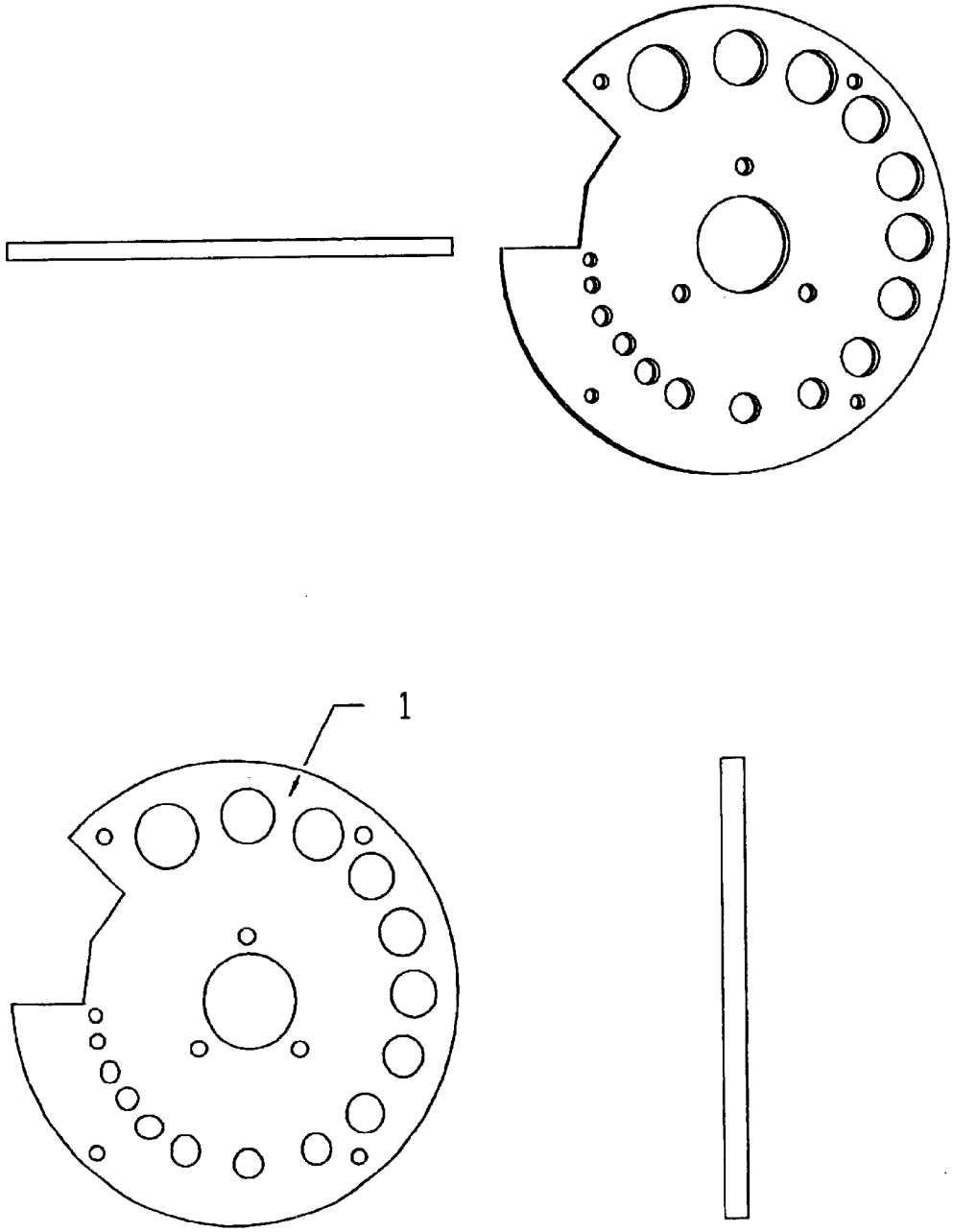
FIG. 3A is a view of the mounting plate.

FIG. 3A is an orthogonal view of the mounting plate. Shown are the indexed through holes, around outside and three mounting plate to motor housing through holes around center armature hole. The four through holes outside of the indexed holes for mounting the mounting plate to center working plate. Also shown is the center hole in which fits over motors armature. Also note the cutout area, this will serve the purpose of retaining an area for all-purpose cleaning. A perspective view is in upper right.

Figure 3B:
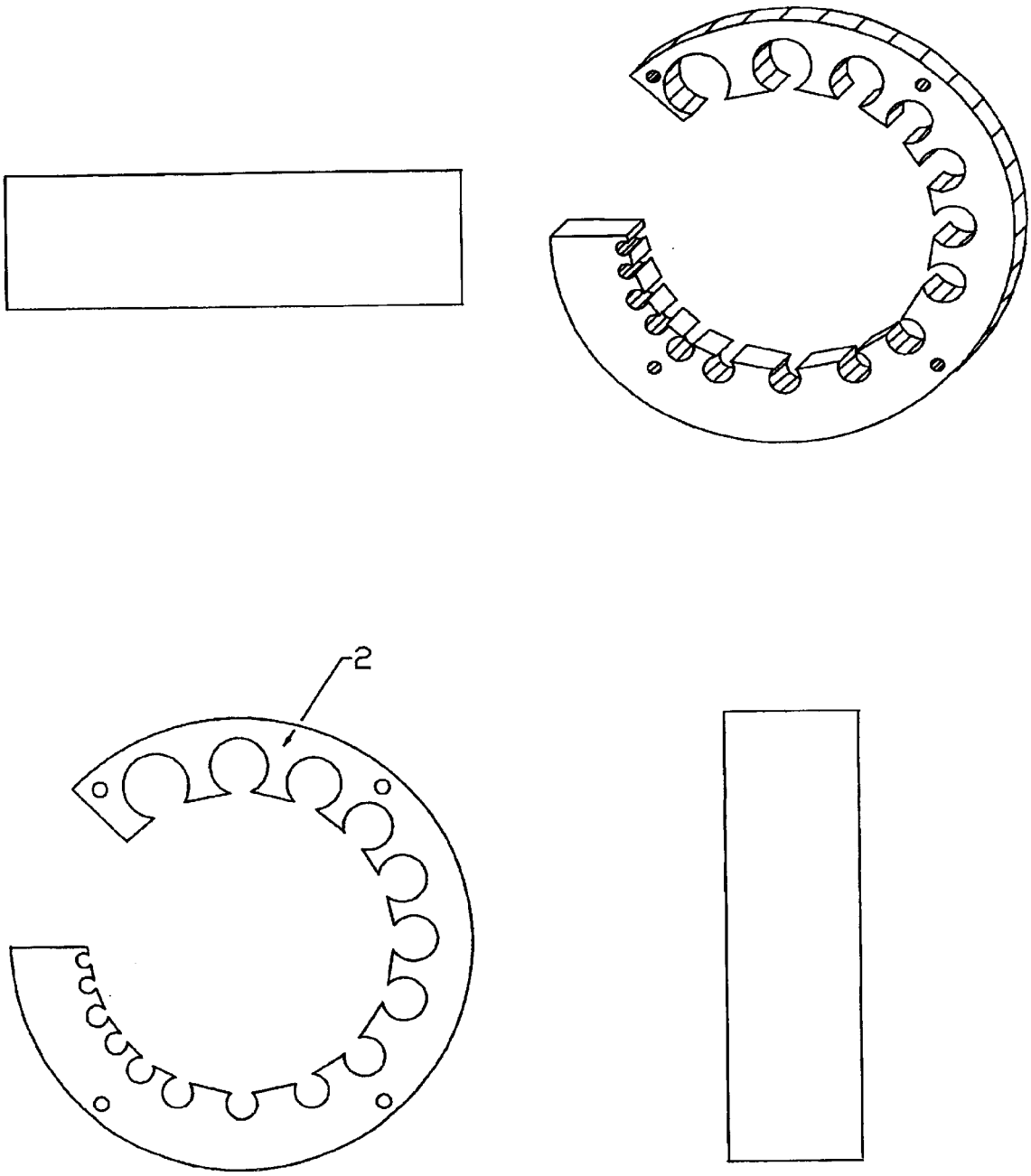
FIG. 3B is a view of the center working plate.

FIG. 3B is an orthogonal view of center working plate, showing the detail of the inner design, which holds parts in place while the cleaning is being done. Also shown are the four tapped holes for mounting the mounting plate and cover plate. The tapped holes are through holes tapped half thickness from each side. Also shown is the inner diameter in which the cleaning wheel will be located and make cleaning contact.

Figure 3C:
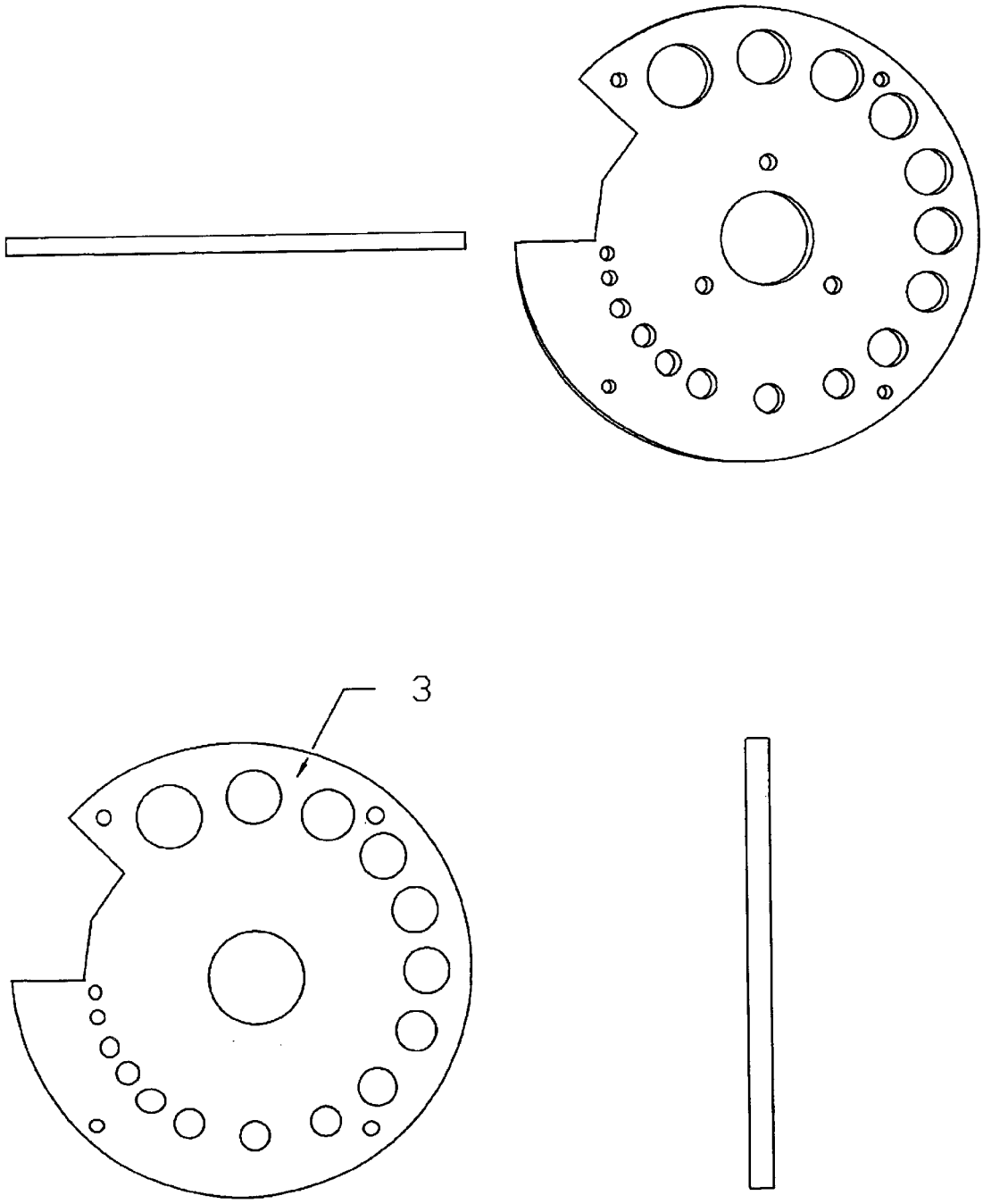
FIG. 3C is a view of the cover plate.

FIG. 3C is an orthogonal view of the cover plate. Showing indexed through holes, four through holes for mounting cover plate to center plate and armature nut tightening through hole. Perspective view located in upper right.

DETAILED DESCRIPTION

This invention FIG. 1 consists of three plates of machined aluminum, steel or other ridged material fastened with screw fasteners shown in FIG. 2—#10. Mounting plate FIG. 1—#1. Center working plate FIG. 1—#2, Cover plate FIG. 1—#3. Also located inside of the center working plate is a round carbon bristle, wire-cleaning wheel FIG. 2—#4. FIG. 2 shows one mounting method used, the invention has been attached to a motorized bench grinder using some of the original parts of the unit. After removal of the armature nut, grinding stone, washers and guard. This will expose the motor housing and holes in which the original guard was attached to the motor FIG. 2—#18. This invention will replace the grinding stone and guard once installed, and shown assembled in FIG. 1. FIG. 2—#5 shows through mounting plate to motor housing holes, which are bored to the motors mounting pattern. The mounting plate will be fastened to the motor using these holes. The four tapped holes FIG. 2—#9, in the center working plate are then used to attach the center working plate to the mounting plate, using the four through holes, FIG. 2—#6. The center working plate FIG. 3B—#2, has been indexed with through holes of various diameters of fastener sizes. FIG. 2—#8, shows an index of through hole diameters, {fraction (1/16)}", {fraction (3/32)}", {fraction 1/8}", {fraction 5/32}", {fraction 3/16}", {fraction 7/32}", {fraction 1/4}", {fraction 9/32}", {fraction 5/16}", {fraction 3/8}", {fraction 7/16}", {fraction 1/2}", {fraction 9/16}", {fraction 5/8}", {fraction 11/16}", 3/4". This index range can be changed to meet different requirements also, and the larger objects large enough to hold by hand safely can be cleaned using the free hand portion of the invention shown as FIG. 1—#16. FIG. 2—#8 indexed through holes are bored offset from the working area of the cleaning wheel, exposing one quarter of the threaded portion of the bolt to the cleaning wheel. This allows the center working plate to secure the bolt from being dragged in to the cleaning wheel, and maintains an even pressure between bolt and cleaning wheel. The cleaning wheel bore diameter depends upon the size of the motor or bench grinder. The invention is dependent upon the size and horsepower of the motor or bench grinder. Therefore The larger the motor or bench grinder, the larger the invention, and more index options the invention may have. The center working plate FIG. 3B—#2, also has four through holes FIG. 2—#9. They are bored through and tapped to a depth of half the thickness of the center working plate from both sides. These are for fastening both, the mounting plate FIG. 3A—#1, and the cover plate FIG. 3C—#3. The cover plate FIG. 3C—#3, also shows the same indexed through holes as described above. FIG. 2—#8. This cover serves to cover the moving cleaning wheel inside and as the working side of the invention. In FIG. 1, the mounting plate #1, center working plate #2 and cover plate #3, are fastened together as an assembly. An index was laid out on cover plate and all through holes were bored through the mounting plate, center working plate and cover plate at same time. The exception being the three mounting plate through holes FIG. 2—#5. These holes are to be laid out and bored through the mounting plate only. Once this has been done the center working plate FIG. 3B—#2 is centered and bored out to accept the diameter of the cleaning wheel FIG. 2—#4. When bore for the center working plate is finished it should be as FIG. 3B—#2. The working model was then assembled as shown FIG. 1 and FIG. 2 using 10–32 .times. 3/4" machine screws, and the cleaning wheel was mounted with the two conical washers FIG. 2—#11. One being placed on each side of the cleaning wheel then tightened down by the armature nut FIG. 2—#13.

Operation

The inventions operation, consist of turning on the motor, and inserting an threaded fastener or bolt into appropriate indexed hole in cover plate, according to the diameter of the bolt or object. Constantly turning bolt by hand, while inserting into the indexed hole. When bolt head is inserted and becomes flush with the cover plate, still turning withdraws bolt from cover plate. Checks bolt for debris and repeat if necessary or move on to next cleaning operation.

Description—Additional Embodiment

Invention can be modified to fit motors and drive systems of multi mounting patterns by changing the mounting pattern of the mounting plate, in FIG. 3A. Invention's size, index and shape can also be changed to accommodate mounting needs and use. Invention can also mount left-hand or right-hand.

Operation-Additional Embodiment

Inventions through holes allow both short and long bolt cleaning.

CONCLUSION, RAMIFICATIONS, SCOPE

Accordingly, the reader will see that this invention and it's ability to be manufactured and used in such universal ways makes it an very useful and time saving tool. One example is the automotive repair field. Cleaning bolts is involved in most every removal and repair job they do. As all know when there is a way to save time and still get the best results possible all save money. This invention also provides an new useful tool that does what it was intended to do and yet leaves room for those free hand cleaning operations that will still occur. This invention and its simplicity means less maintenance and less to go wrong and less down time. This invention provides an cost effective answer to safe, fast, clean threads. Although the description above contains much specificity, these should not be construed as limiting the scope of the invention but as merely providing illustrations of some of the presently preferred embodiments of this invention. For example, the invention size, shape of the housing, materials used to manufacture the invention, or mounting methods etc. Thus the scope of the invention should be determined by the appended claims and their legal equivalents, rather than by the examples given.

I claim:

1. A universal bolt cleaning apparatus comprising:

a) a housing comprising a mounting plate and a cover plate with each of the plates including a plurality of bores therein of varying diameters, the mounting and cover plates being secured to opposite sides of a generally annular working plate such that the bores of the plates are arranged in aligned pairs of bores of similar size, the working plate further including a plurality of bores aligned with each of the pairs of bores of the mounting and cover plates, the bores of the working plate each being open at the inner diameter thereof, the mounting plate further including means for securing the housing to a motor having a rotary output shaft;

b) a generally cylindrical cleaning member positioned within the housing between the mounting and cover plates and within the inner diameter of the working plate and adapted to be coupled to the output shaft of the motor so as to be rotatable therewith, said cleaning member having a peripheral cleaning surface and axis of rotation generally parallel to said bores, the diameter of the cleaning member is such that the peripheral cleaning surface thereof is adjacent the open regions of the bores of the working plate; and c) whereby objects of varying sizes may be placed within a corresponding bore such that an outer portion thereof is brought into contact with the peripheral cleaning surface of the rotary cleaning member.

* * * * *